US007010814B2

(12) United States Patent
Benziger

(10) Patent No.: US 7,010,814 B2
(45) Date of Patent: Mar. 14, 2006

(54) WEIGHT-BEARING HEADWEAR, COMPONENTS THEREOF, AND METHODS OF USE

(76) Inventor: John Reed Benziger, 40 Johnson Heights, Waterville, ME (US) 04901

( * ) Notice: Subject to any disclaimer, the term of this patent is extended or adjusted under 35 U.S.C. 154(b) by 0 days.

(21) Appl. No.: 10/786,773

(22) Filed: Feb. 24, 2004

(65) Prior Publication Data

US 2004/0163162 A1 Aug. 26, 2004

Related U.S. Application Data

(60) Provisional application No. 60/449,012, filed on Feb. 24, 2003.

(51) Int. Cl.
*A42B 1/24* (2006.01)

(52) U.S. Cl. ..... 2/209.13; 2/171.2; 482/10; 482/105

(58) Field of Classification Search ..... 2/209.13, 2/171.2, 182.3, 175.4, 195.5, 410, 425; 482/105, 482/10, 92; 601/39
See application file for complete search history.

(56) References Cited

U.S. PATENT DOCUMENTS

| | | | | | |
|---|---|---|---|---|---|
| 500,686 | A | | 7/1893 | Corker | |
| 1,047,212 | A | | 12/1912 | Hamilton | |
| 2,333,987 | A | * | 11/1943 | Dandy | 2/425 |
| 2,357,746 | A | * | 9/1944 | Kuss | 482/10 |
| 3,103,015 | A | * | 9/1963 | Plastino | 2/422 |
| 3,124,353 | A | * | 3/1964 | Sharkey | 482/10 |
| 3,128,095 | A | * | 4/1964 | Sharkey | 482/10 |
| 3,342,036 | A | * | 9/1967 | Gruget | 405/186 |
| 3,759,510 | A | | 9/1973 | Jackson, Jr. | |
| 3,820,780 | A | * | 6/1974 | Tarbox | 482/10 |
| 4,168,060 | A | | 9/1979 | Hohenfeldt | |
| 4,312,076 | A | | 1/1982 | Gamm | |
| 4,339,124 | A | | 7/1982 | Vogler | |
| 4,632,389 | A | * | 12/1986 | Moss | 482/105 |
| 4,858,598 | A | | 8/1989 | Halpern | |
| 4,925,185 | A | | 5/1990 | Gongwer et al. | |
| 4,953,856 | A | | 9/1990 | Fox, III | |
| 4,967,737 | A | | 11/1990 | Bassett et al. | |
| 4,988,093 | A | * | 1/1991 | Forrest et al. | 482/10 |
| 5,046,484 | A | | 9/1991 | Bassett et al. | |

(Continued)

OTHER PUBLICATIONS

C. H. Turner and A.G. Robling, "Designing Exercise Regimens to Increase Bone Strength," Exerc. Sport Sci. Rev. 2003, 31:1, 45-50.

(Continued)

*Primary Examiner*—Rodney M. Lindsey
(74) *Attorney, Agent, or Firm*—Joseph Fischer; Beusse, Brownlee, Wolter, Mora & Maire, P.A.

(57) ABSTRACT

Disclosed and claimed are cap (120), skullcap (200), hat (270), and hat insert (350) devices comprising a weight-increasing layer, such as an elastomeric weight layer (114, 214, 350, 414, 454, 514). The elastomeric weight layer (114, 214, 350, 414, 454, 514) is comprised of an elastomer and weighted bodies. In some embodiments the weight-increasing layer is shaped to conform to the crown of the head of a person wearing headwear of the present invention. In other embodiments a weighted component fits within a hat. Other forms of the weight-increasing layer include a double-walled bladder structure (700), shaped to conform to a person's head, into which weighted material is added. Exercise with such devices serves to increase the bone strengthening weight stress experienced by the wearer's spinal column and to encourage the wearer to maintain an improved, healthier posture.

8 Claims, 11 Drawing Sheets

U.S. PATENT DOCUMENTS

| | | | | | |
|---|---|---|---|---|---|
| 5,269,026 | A | * | 12/1993 | McManus | 2/411 |
| 5,289,591 | A | * | 3/1994 | Andersen | 2/411 |
| 5,514,056 | A | * | 5/1996 | Ronca et al. | 482/105 |
| 5,887,289 | A | * | 3/1999 | Theoret | 2/425 |
| 6,000,066 | A | * | 12/1999 | Williams | 2/422 |
| 6,110,080 | A | * | 8/2000 | Niv | 482/105 |
| 6,217,482 | B1 | | 4/2001 | Yoo et al. | |
| 6,299,569 | B1 | | 10/2001 | Rich | |
| 6,402,666 | B1 | | 6/2002 | Krull | |
| 6,592,502 | B1 | | 7/2003 | Phillips | |
| 2003/0073549 | A1 | * | 4/2003 | Hatch | 482/92 |

OTHER PUBLICATIONS

J A. Todd and R J Robinson, "Osteoporosis and exercise," Postgrad. Med Journal, 2003.79:320-323.

Diane Feskanich, W. Wilet and G. Colditz, Walking and Leisure-Time Activity and Risk of Hip Fracture in Postmenopausal Women, JAMA 2002, 288:18, 2300-2306, 2305.

Wolfgang Kemmler et al. , "The Erlangen Fitness Osteoporosis Prevention Study: A Controlled Exercise Trial in Early Postmenopausal Women with Low Bone Density—First-Year Results," Arch Phys Med Rehabit, 2003:84:673-682.

Khan e tal., Physical Activity and Bone HealthHuman Kinetics, publ., 2001, pp. 11-34.

Michael O'Shea, lay press "Parade's guide to Better Fitness," pp. 14-15, Oct. 12, 2003.

* cited by examiner

Fig. 1E
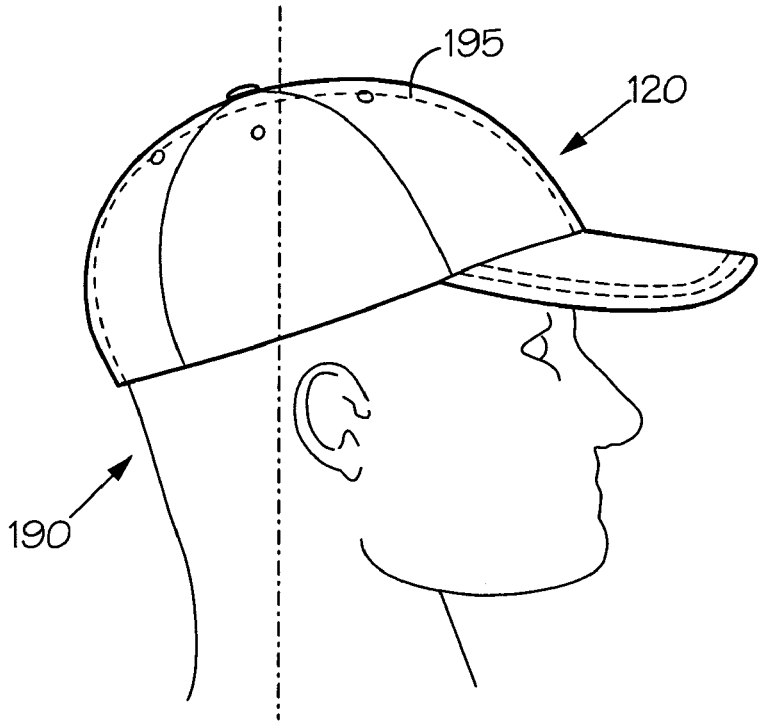
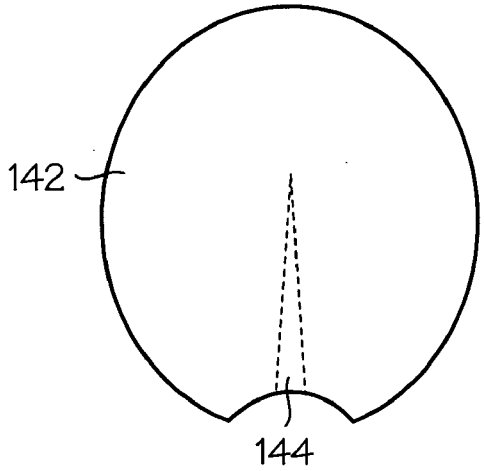
Fig. 1F

WEIGHT-BEARING HEADWEAR, COMPONENTS THEREOF, AND METHODS OF USE

CROSS REFERENCE TO RELATED APPLICATIONS

This application claims the benefit of U.S. Provisional Application No. 60/449,012, filed Feb. 24, 2003, in accordance with under 35 USC § 119(e). The indicated U.S. Provisional Application is incorporated by reference in its entirety to this application.

FIELD OF THE INVENTION

The present invention relates to headwear such as caps and hats, and to subcombination components thereof, that comprise a weight component. In certain embodiments, the added weight is in the form of a weighted elastomeric layer comprised of an elastomer and weighted bodies. Such headwear, when worn during certain activities, encourages good posture and increases weight-bearing forces on the spinal column and supporting tissues.

BACKGROUND OF THE INVENTION

In our health conscious world, many people share the desire to maintain or improve their posture and to avoid or retard typically progressive loss of bone mineral density and/or strength. Such loss, when progressing to a certain point, results in the development of osteoporosis. In this regard, the integrity of the spinal column and its supporting muscles and tendons is of prime importance. A means to encourage good posture and to maintain or strengthen the bone and supportive tissues of the spine would be advantageous.

An age-old method to encourage the development of good posture is to place a book atop the head and try to walk about and carry on normal activities. The sensation of weight on top of the head and the desire to keep it balanced does, for many people, promote keeping the back straighter, the shoulders back, the chest forward and overall better, healthier posture. The present invention uses this principal to encourage good posture in a more sustained, more convenient, less conspicuous, and less hazardous manner than the book technique.

Osteoporosis, meaning 'porous bone', is a bone loss disease that may develop with aging and results in loss of height and a badly curved spine. Known factors that promote osteoporosis include sedentary life style, a diet low in calcium and vitamin D, inadequate weight bearing exercise, female gender and menopause. In addition to its effects on the spine, osteoporosis is the also the major cause of hip and wrist fractures. Osteoporotic bones lose calcium and protein, and the effected bones becomes less dense, weaker, and more vulnerable to breaking with even minor trauma. When a spinal vertebra breaks, it collapses resulting in pain, disability, loss of height and increased spinal curvature. Osteoporosis has been defined as "reduction in the quantity of bone or atrophy of skeletal tissue; an age-related disorder characterized by decreased bone mass and increased susceptibility to fractures," while osteopenia, a less severe condition, has been defined as "decreased calcification or density of bone" and "reduced bone mass due to inadequate osteoid synthesis." (Stedman's Electronic Medical Dictionary, v. 5.0)

Bone is a living tissue that is constantly being formed, removed, and remodeled in response to the stress it experiences. For instance, a fractured bone is repaired, reshaped, and strengthened in response to the forces put on it by the surrounding muscles and supporting tissues. Also, when bone experiences greater than usual stress, new bone is formed in parallel with the direction, or lines of stress to strengthen the bone. For example, bones in the right arm of a right-handed tennis player become denser and stronger than those on the left.

According to one current theory, the physiological process that permits the strain on a bone to adjust structure (thus, in response to exercise loading, to stimulate bone growth), involves four steps: mechanocoupling; biochemical coupling; transmission of the biochemical signal; and the effector response. Where an exercise regime results in a net increase in bone mass, bone-forming cells identified as osteoblasts, deposit more bone mass than is being removed by bone-removing cells identified as osteoclasts. The details of these steps, and the factors of movement and exercise that are correlated with net bone growth, are more fully described in chapters 2 and 3 of Physical Activity and Bone Health, Khan et al., Human Kinetics, publ., 2001, pages 11–34 ("Khan paper"), which are particularly incorporated by reference for such explanation.

The opposite effect of beneficial exercise is also true. Inactivity reduces the stresses on bones, and results in loss of calcium, protein and bone strength; in other words, osteopenia and, more extremely, osteoporosis. The reduction in bone mass density that characterizes osteoporosis generally results when bone loss outpaces bone formation. The balance between these two counter-balancing activities is affected by hormones, calcium intake, vitamin D and its metabolites, weight, smoking, alcohol intake, exercise, and other factors. As to the importance of load on the bones, it has been reported that astronauts lose bone mass at a rate of 1 to 2 percent a month in the zero gravity, reduced bone stress environment of space.

Although it is recognized that weight-bearing exercise can improve the status of an individual's bone mass, many persons who attempt such improvement by exercise do not attain a time-efficient result. To ameliorate such inefficiency, the apparatuses of the present invention conveniently and unobtrusively add to the weight of the head and therefore increase the weight force, or stress, along the axis of the spinal column. This added force on the entire length of the spine, which over time with regular use, stimulates formation of strengthening new bone within the spinal vertebrae. With proper use, it also helps maintain and strengthen the muscles and tissues that support the spine thereby helping to promote good, healthy posture. Overall, with proper and consistent use, these apparatuses provide means to tip the bone growth/bone loss balance toward bone growth, thereby providing a chance of slowing or stopping progressive bone mass loss.

As to the types of beneficial exercise, numerous forms of exercise are well known in the art. Some, such as some forms of yoga, boast a long history of development. Also, the history of ancient Greece and Rome provides evidence of the long recognition of the value of exercise in general health. In recent years, as life span has extended in certain countries, such as so-called "Western civilizations," various degenerative diseases related to aging have emerged as common concerns. Among these diseases are osteoporosis and other states that adversely affect the condition of the bones of an aging person. Commonly accepted knowledge of the relationships between exercise and the general maintenance of bone mass, osteoporosis, and other bone degenerative conditions defined by current medicine, includes the following:

1. For females, load-bearing exercise during pre-adolescent and adolescent years (i.e., 9–18 years of age) is strongly related to bone mass density and bone strength. It has been stated that bone mass density and bone strength of a young adult correlates to improved status of bones during post-menopausal senior years, when bone mass typically declines. Soccer, basketball and tennis, for example, are considered "good load-bearing sports for girls." (from lay press' "Parade's guide to Better Fitness," Michael O'Shea, pp. 14–15, Oct. 12, 2003);

2. Load-bearing exercise by older subjects, including post-menopausal women, has been shown to reduce bone loss from the spine (See "Review: exercise reduces bone loss from the spine of postmenopausal women," 2003:50:6, www.evidencebasednursing.com, authors D. Bonaiuti et al.; "Osteoporosis and exercise," Postgrad. Med Journal, 2003: 79:320–323, authors J. A. Todd and R. J. Robinson, for instance, references 23 and 24);

3. In some cases, load-bearing exercise by post-menopausal women, including those diagnosed with osteoporosis, has been shown to increase bone mass and muscle strength (See for instance, "Osteoporosis and exercise," Postgrad. Med Journal, 2003:79:320–323, authors J. A. Todd and R. J. Robinson)

4. A strong positive relationship exists between exercise intensity and osteogenic stimulation (See summary of papers in "The Erlangen Fitness Osteoporosis Prevention Study: A Controlled Exercise Trial in Early Postmenopausal Women with Low Bone Density—First-Year Results," Arch Phys Med Rehabil, 2003:84:673–682, Wolfgang Kemmler et al. ("Erlangen paper")

5. Exercises with an unusual strain distribution, i.e., aerobics or games (i.e., sports), provide more osteogenic stimulus than more constrained exercises such as walking or running (See summary of papers in Erlangen paper, and Khan paper, page 29); and 6. Exercise programs that combine ground and joint reaction forces are superior to exercise programs that only supply one type of force (See summary of papers in Erlangen paper).

Thus, the benefits of exercise are widely recognized, particularly benefits dealing with bone strength, and with bone strength for senior years, more particularly for post-menopausal women. Such recognition has lead to a number of preventative and treatment regimes designed to address the deteriorating condition of the bones of an aging person.

However, despite the long recognition of the value of exercise in general, and despite the recent surge in health and fitness programs and regimes, there still exists a need to provide more convenient and more effective means to improve the bone condition of the spine. The present invention provides such means in its various embodiments, which may be used in a range of activities. Without being bound to a particular theory, the various embodiments and methods of the present invention advantageously improve the effectiveness of routine activities (i.e., non-dedicated exercise of everyday walking about on errands, etc.), and of dedicated forms of exercise (running, jogging, etc.), as to improvement in bone condition of the spine. Also while not being bound to a particular theory, the prior art did not appreciate the benefit of direct-load on the spine (as taught in the present invention), particularly in low to moderate weight loads for extended exercise periods. Instead the prior art taught more limited exercises with higher-weight direct loads, and exercises that provided lateral, non-direct loading upon the spine. It is believed that the latter, lateral, non-direct loading does not benefit the weight-bearing maintenance and development of the spine, nor the induction of bone growth, in a manner that is as beneficial to an individual as the apparatuses, systems and methods of the present invention.

Statements and conclusions from scientific review articles are supportive of some of the above statements. In "Osteoporosis and exercise," Postgrad. Med Journal, 2003: 79:320–323, authors J. A. Todd and R. J. Robinson reviewed a number of research studies on the effect of exercise on bone mineral density ("BMD"). These authors summarize that running and other "weightbearing sports" (i.e., competitive weightlifting, volleyball, basketball, squash, speed skating, but not swimming) are associated with increased BMD (page 321). As to walking, the authors stated, "Regular brisk walking can maintain BMD in previously sedentary postmenopausal women," and also stated that in one study of the effects of walking on BMD, " . . . BMD at the spine and calcaneum decreased in the control group but small increases were seen in the walking group with the differences reaching statistical significance at the calcaneum." (page 321) In their section entitled "Optimum Type and Frequency of Exercise," these authors state that "Intervention studies also suggest that high impact activities are better at increasing BMD than low impact activities. Low impact activities only seem to help prevent further loss. Other reviewers have concurred with this view." (Page 322, citations omitted.) Finally, in Table 1 also on page 322, entitled "Different forms of exercise and their impact on BMD," where the forms of exercise are ordered based on "Impact on BMD," walking is listed second, just after swimming, with the indication "Protects against further loss" as to its impact on BMD. Thus, walking in its conventional form is considered a low impact form of exercise that is not as effective as "higher impact" exercises such as vigorous aerobic exercise, weight training, running and squash.

However, through use of the present invention, it is possible to elevate walking to a more effective form of exercise for improvement of the bone condition of the spine. Further, in that various embodiments of the present invention are in the form of unobtrusive, conventional headwear, wearing these during normal daily activities provides opportunities for persons to benefit from the additional weight load to the spine during such non-dedicated-exercise activities.

More specifically as to walking, one article, analyzing the effect of walking exercise in one cohort of postmenopausal women, calculated that " . . . walking for 4 [hours per week] or more was associated with a 41% lower risk of hip fracture. A faster pace was also associated with lower risk, perhaps because of a greater impact on the bone." "Walking and Leisure-Time Activity and Risk of Hip Fracture in Postmenopausal Women, Diane Feshanich, W. Willet and G. Colditz, JAMA 2002, 288:18, 2300–2306, 2305.

Despite these and numerous other articles substantiating the benefit of walking and other exercise, many persons do not sustain sufficient exercise over time to achieve and/or maintain a desired level of bone strength and density. Many persons do not want to take time to exercise, or only take time to exercise inconsistently.

Also, as to the present invention, the art has failed to appreciate that routine walking exercise regimes can be "upgraded," per the teachings of the present invention, so as to offer and provide substantial benefits specific to the bone condition of the spine. Also, wearing headwear of the present invention in forms of exercise other than walking, for instance volleyball, running, and tennis, whether by youth, adults or the elderly, provides the potential for obtaining more effective exercise with regard to growth and maintenance of the bone mass of the spine. Advantageously, the benefit of limited exercise can be increased by wearing the headwear of the present invention during such limited exercise.

Finally, although BMD is the common parameter measured to assess the effectiveness of an exercise regime or therapy (i.e., a medication), and as a predictor of the likelihood of a problem related to decreased bone mineral content with aging or other condition, at least one scientific article provides evidence that BMD is "merely a surrogate measure for bone strength" and may not accurately assess bone strength. "Designing Exercise Regimens to Increase Bone Strength," C. H. Turner and A. G. Robling, Exerc. Sport Sci. Rev. 2003, 31:1, 45–50. Thus, an exercise regime that improves the actual strength of the bone may be underestimated by standard BMD analyses.

All patents, patent applications, patent publications, and all other publications cited herein are incorporated by reference to the same extent as if each individual publication or patent application was specifically and individually set forth in its entirety.

SUMMARY OF THE INVENTION

In accordance with the present invention there are disclosed herein headwear and components thereof, for example a head piece, a hat, a cap, and a skullcap. Such headwear is comprised of a weight-increasing layer, which when within or beneath a hat, cap or the like, is inconspicuous. This makes the wearing of such headwear for exercise purposes unobtrusive. As used herein for convenience, any of these types of headwear are collectively referred to as "headwear of the present invention."

In typical embodiments of the present invention, certain embodiments of headwear of the present invention are constructed as an integral part of a common, or conventional, style hat creating a complete, ready to wear unobtrusively weighted headwear to be marketed as 'WEIGHTHAT™'.

Alternatively, certain embodiments of headwear of the present invention are fitted with a decorative cover, such as a scarf or bandana, and used without additional adornment creating a complete, ready to wear unobtrusively weighted headwear to be marketed as 'WEIGHTCAP™'.

Alternatively, certain embodiments of headwear of the present invention are fitted with an outer surface 'hat attachment system' allowing it to be attached to a wearer's current hat, thereby creating, in combination, an unobtrusively weighted headwear marketed as 'WEIGHTCAP INSERT™'.

In one embodiment of the headwear of the present invention, the general configuration is similar to a typical close fitting 'baseball style cap' without the visor or top button. Specific embodiments are sized, selectively, in small, medium and large to conform with typical head sizes, and in certain such embodiments there is an inner base layer that is adjustable to allow the wearer a secure and comfortable fit. In certain of these embodiments, this base layer also keeps the headwear in place and prevents slippage during activity.

The component of the headwear that provides additional weight, compared to the typical weight of a conventional hat, cap or other headwear, can be provided by a number of approaches.

In one approach, additional weight is provided by incorporation of an internal (non-visible) layer of weight that conforms to the general shape of the head of the wearer.

In another approach, such additional weight, provided by incorporation of an internal (non-visible) layer of weight that conforms to the general shape of the head of the wearer, such layer is elastomeric, and thereby, affords greater comfort and a generally better fit to wearers.

In another approach, a portion of the additional weight is provided by one of the non-elastomeric or the elastomeric layers described herein, and an additional portion of additional weight is provided by weights that are attached separately to the headwear. That is, such supplemental weights are attachable by the user of the headwear when additional weight is desired. Such supplemental weights are selectively visible to an onlooker, or not visible to an onlooker, while attached to the headwear.

It is noted that a key advantage of certain embodiments of the headwear of present invention is the ability of a wearer of such headwear to be among people without such people noticing or fully appreciating that the headwear is not "conventional" headwear. That is, when a user of the headwear of the present invention does not want others to know that the headwear is weighted, is concerned about his/her appearance, and wants to enhance the effects of his/her exercise, embodiments of the headwear are selected that look like any standard headwear.

Other aspects of the present invention relate to methods of using the headwear of the present invention in different forms of exercise, to benefit wearers thereof. Such benefits include, but are not limited to, improved posture, increased development of bone mineral density during exercise with the headwear (generally for younger users), and decreased loss of bone mineral density during exercise with the headwear (generally for older users). Thus, generally, through the regular use of headwear of the present invention a user may facilitate maintaining or improving the strength and structure of the spine.

Still other aspects, objects, advantages, and/or features of the present invention will become readily apparent by those skilled in the art from a review of the following detailed description and drawings. The detailed description shows and describes certain embodiments of the present invention, including, simply by way of illustration, the best mode contemplated of carrying out the present invention. As will be realized, the present invention is capable of other and different embodiments and its several details are capable of modifications in various obvious respects, without departing from the invention. Accordingly, the drawings and description are illustrative in nature and not restrictive.

BRIEF DESCRIPTION OF THE FIGURES

FIGS. 1A–F depict various components, relationships, and aspects of a weighted baseball-style cap of the present invention. FIG. 1A provides a perspective view of a fabric liner-type underlayment of a cap, prior to placement of an elastomeric weighted layer over it. FIG. 1B provides a perspective view of the fabric liner of FIG. 1A after placement over it of an elastomeric weighted layer. FIG. 1C provides an upside-down perspective view of a weighted baseball-style cap of the present invention showing certain features of this embodiment. FIG. 1D provides a cross sectional view of the hat in FIG. 1C taken along an axis A—A in FIG. 1C. FIG. 1E depicts a weighted cap of the present invention, such as that of FIG. 1C, positioned on the head of a user. FIG. 1F depicts an embodiment of a weighted cap insert depicting one size-modifying approach.

DETAILED DESCRIPTIONS OF EMBODIMENTS

Figure 1A:
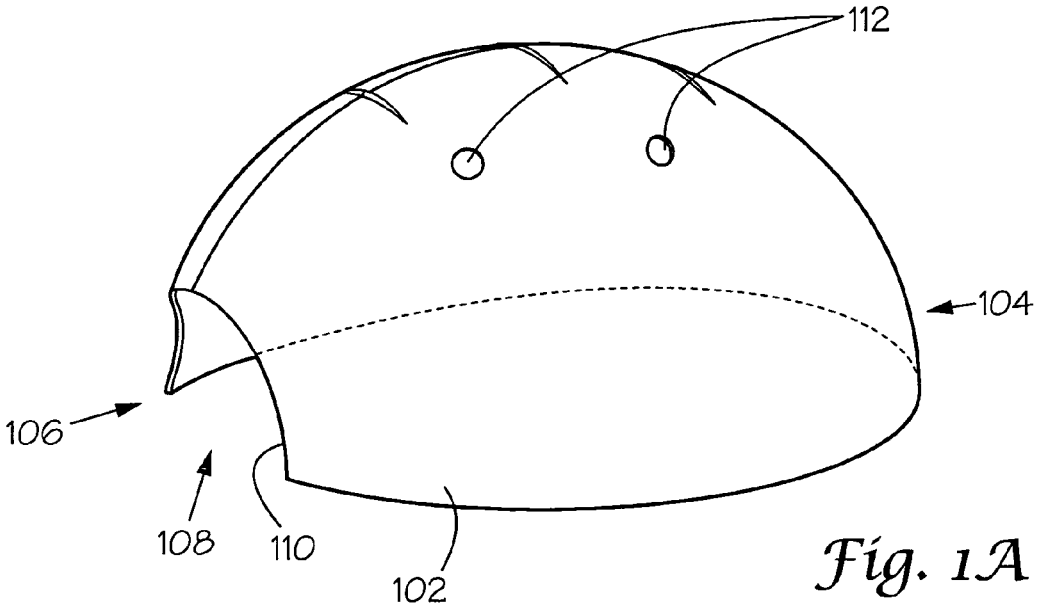

As used herein, "headwear of the present invention" is meant to be any form of hat, cap or other conventional head piece which additionally comprises a weight-adding component of the present invention. Conventional styles of such headwear include, but are not limited to, a billed baseball style cap and a brimmed walking hat. However, it is recognized that any style or fashion of headwear may incorporate one or more such weight-adding components, and thereby be headwear of the present invention. More particularly, headwear of the present invention includes the conventional headwear, as defined herein, in which a weight-adding component of the present invention is incorporated, associated with, inserted, or placed beneath in combination.

More particularly, generic styles of hats that are amenable to use in the present invention include the following: boater; bowler; bucket; cowboy hat; derby; fedora; floppy hat; hamburg; pillbox; Stetson-styled hat; and trilby. Generic styles of caps that are amenable to use in the present invention include the following: baseball cap; beret; cloche; fez; newsboy cap; skullcap; and turban. These lists are meant to be exemplary and not limiting. Also, stylistic variations of such hats and caps can be made and are still within the scope of the present invention when with each of these is associated, inserted, or placed beneath in combination a weight-bearing component as described and claimed herein. Particularly for a description of characteristics of some of the hats and caps listed above, the following references are incorporated by reference: "HATS: A History Of Fashion In Headwear," by Hilda Amphlett, Richard Sadler, Publisher, 1974, and "The Mode In Hats And Headdress," by R. Turner Wilcox, Charles Scribner's Sons, 1945.

The above listed hats and caps, and the above listed generic styles, fall within the scope of "conventional headwear," this term comprising "conventional hats" (also, "conventional-styled hats") and "conventional caps" (also, "conventional-styled caps"). Conventional headwear is contrasted with specifically styled exercise helmets, athletic protective helmets, industrial helmets, and other devices that are conspicuous when worn during everyday activities and outside their normal scope of use. When a weight-adding component of the present invention is part of, added to, or attached below, any of those conventional hats and caps, such hat or cap is headwear of the present invention.

As used herein and as generally known in the relevant arts, an elastomer refers to any of a group of ductile, tough polymers that frequently have high elasticity. Most elastomers are synthetic, and were developed either as cost competitive substitutes for vulcanized natural rubber or were formulated to meet a specific property requirement found lacking in natural rubber. Because most elastomers lend themselves to being compounded with many different materials, the choice of elastomer compounds available and the range of their uses is unlimited. Synthetic rubber refers to a variety of compounds derived from crude oil that are used to complement or substitute for natural rubber. Many rubber products, including tires, consist of a combination of synthetic and natural rubbers optimized for a specific usage. As used herein, the term "elastomeric" is taken to mean any composition that possesses the ductile and resilient ("tough") properties of an elastomer, whether comprised of synthetic or natural materials, or combinations of these. Flexible silicone polymers and ductile but resilient plastic matrices also are considered elastomeric. Further, as used herein, the term "weighted elastomeric aggregate" is taken to mean a composition that possesses the properties of an elastomer, and that also contains within its structure numerous particles, also referred to herein as "weighted bodies," having a specific gravity at least about 1.5 grams/cubic centimeter ("$g/cm^3$"), which includes sand particles, more particularly having a specific gravity at least about 7.0 $g/cm^3$, which includes iron, steel and their alloys, and even more particularly having a specific gravity at least about 10.0 $g/cm^3$, which includes lead, other denser metals, and their alloys. Examples of solid, weight-increasing materials include, but are not limited to: sand; pebbles; metal shot or pellets (such as iron, steel, and lead); and metal powders. Organic material such as dried beans alternatively may be used. These weight-increasing materials increase the average density of the weighted elastomeric aggregate, thereby providing a finished layer or piece of material that possesses a desired total weight in a small volume, capable of being incorporated into, associated with, inserted into, or placed beneath (in combination) a hat or cap unobtrusively.

Although the embodiments disclosed in the figures are comprised of elastomeric weighted layers that are weighted elastomeric aggregates, other forms of elastomeric forms and layers, inserted into hats to impart weight, are within the scope of the present invention. For instance, not to be limiting, a polymeric mixture may be selected or prepared that has sufficiently high specific gravity that it forms a desired shape and size having a desired weight without the addition of a higher specific gravity weighted bodies.

FIGS. 1A–F depict components, their interrelationships, and the construction of one embodiment of the present invention, providing details of certain aspects that may be altered from one embodiment to another. FIG. 1A is a perspective view of an underlayment, here shown as fabric liner 102, prior to placement of an elastomeric weighted layer atop the liner. The underlayment fabric liner 102 has a front end 104 and a rear end 106, the latter having a semicircular opening 108 with edges 110. FIG. 1A shows ventilation holes 112 positioned to provide for venting of warm air from within the hat, as worn during exercise. Such ventilation holes 112 are not required, and their presence and arrangement vary from embodiment to embodiment.

Figure 1B:
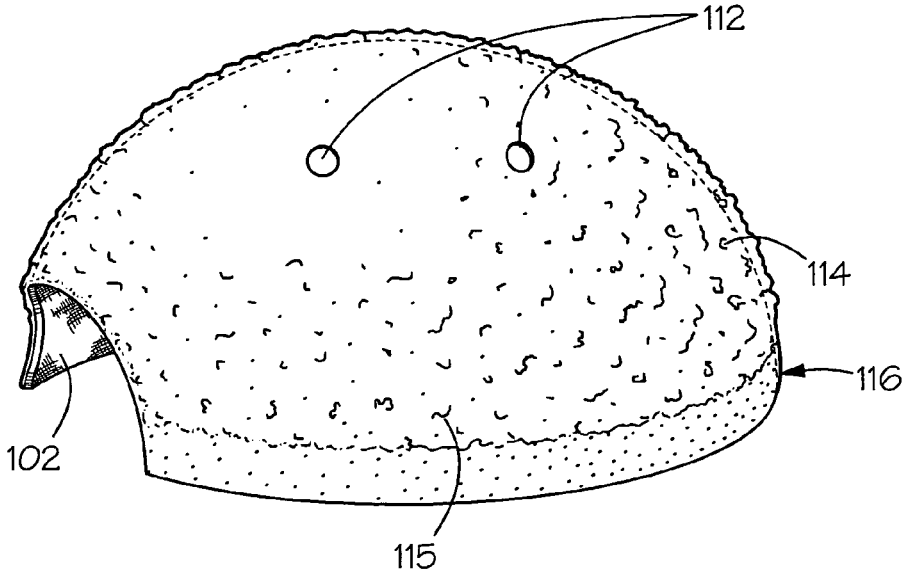

FIG. 1B provides a perspective view of a fabric liner 102 after placement of elastomeric weighted layer 114 atop liner 102. In some methods of construction, such as as depicted here, the elastomeric weighted layer 114 is formed directly onto liner 102. That is, liner 102 serves as a mold or form over which the elastomeric weighted layer 114 is applied, such as by brushing, when the elastomeric weighted layer is in a liquid, pourable or brushable state. In other embodiments, not shown here, an elastomeric weighted layer may be formed in a mold, such as by injection molding, and later attached or contacted to a liner such as the liner 102 depicted in FIG. 1A. The lumpy surface 115 of the brushed on elastomeric weighted layer 114 is depicted in FIG. 1B. Molded elastomeric weighted layers typically are smoothly finished owing to the mold surfaces.

Figure 1C:
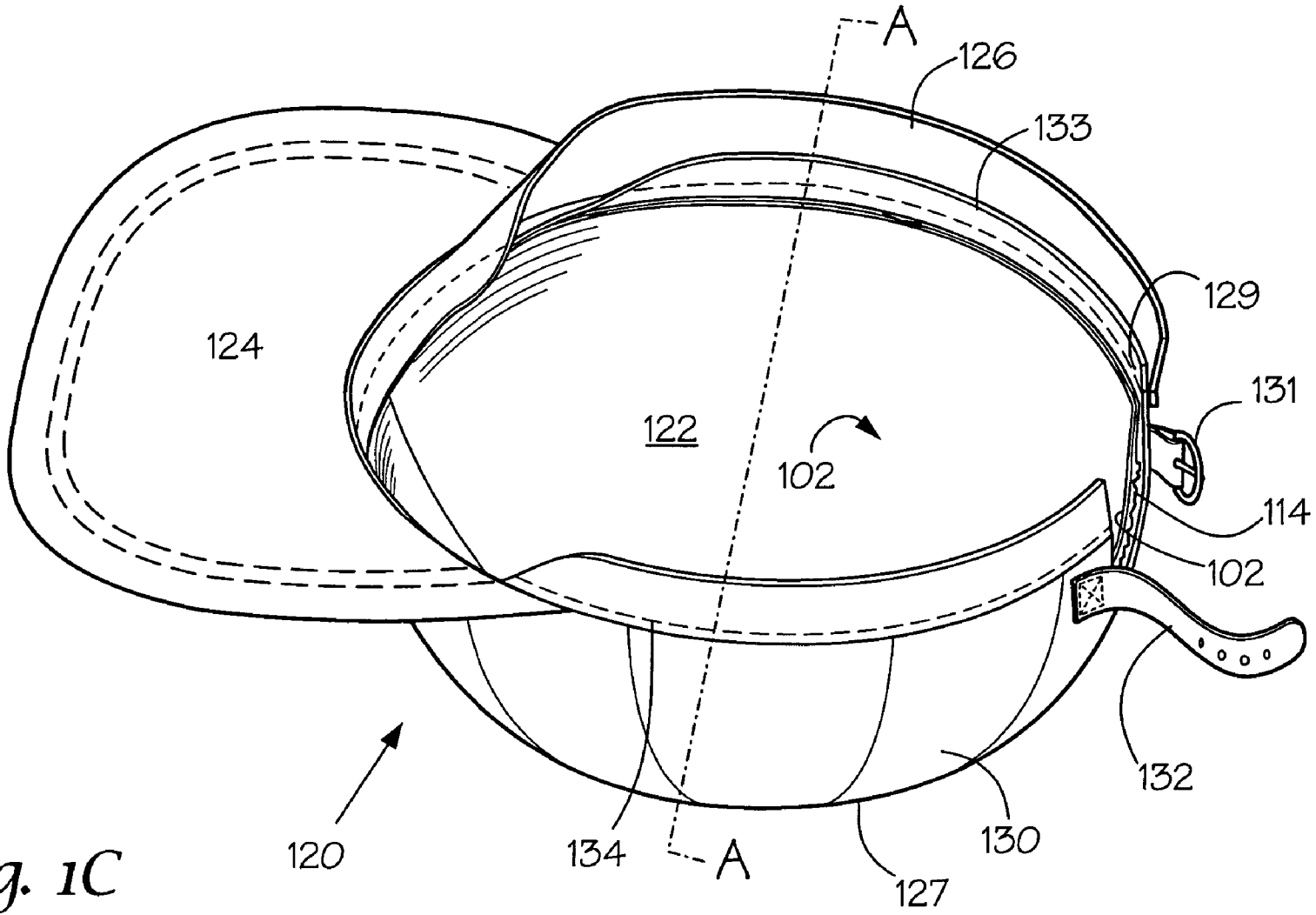

In FIG. 1B the lower outside perimeter 116 of the elastomeric weighted layer 114 is beveled smooth and thinned to better fit within a bill-type baseball cap 120, which is depicted in FIG. 1C in an upside-down view showing certain features of this embodiment. The bill-type baseball cap 120 in FIG. 1C is shown with the combined liner 102 and elastomeric weighted layer 114 of FIG. 1B inserted into the interior concavity 122 of the cap 120. As is typical of bill-type baseball caps, the bill-type baseball cap 120 also is comprised of a front bill 124, a hat band 126, a crown 127 (having an interior side 129 defining interior concavity 122 and an exterior side 130), a mating size adjustment buckle 131 and a size adjustment strap 132. An outer edge 133 of the material that forms the crown 128 extends beyond stitching 134 that attaches the hat band 126 to the crown 128. The hat band 126 folds over the perimeter 116 of the elastomeric weighted layer 114, supporting the latter in place. The hat band 126 may be made of absorptive material and may serve as a sweatband in some embodiments.

In FIG. 1C, between the size adjustment buckle 131 and size adjustment strap 132, the side edges of liner 102 and elastomeric weighted layer 114 are visible. The relationship and positioning of these components are shown FIG. 1D, which is a cross section view of a hat of the present invention taken from along an axis such as axis A—A in FIG. 1C.

Figure 1D:
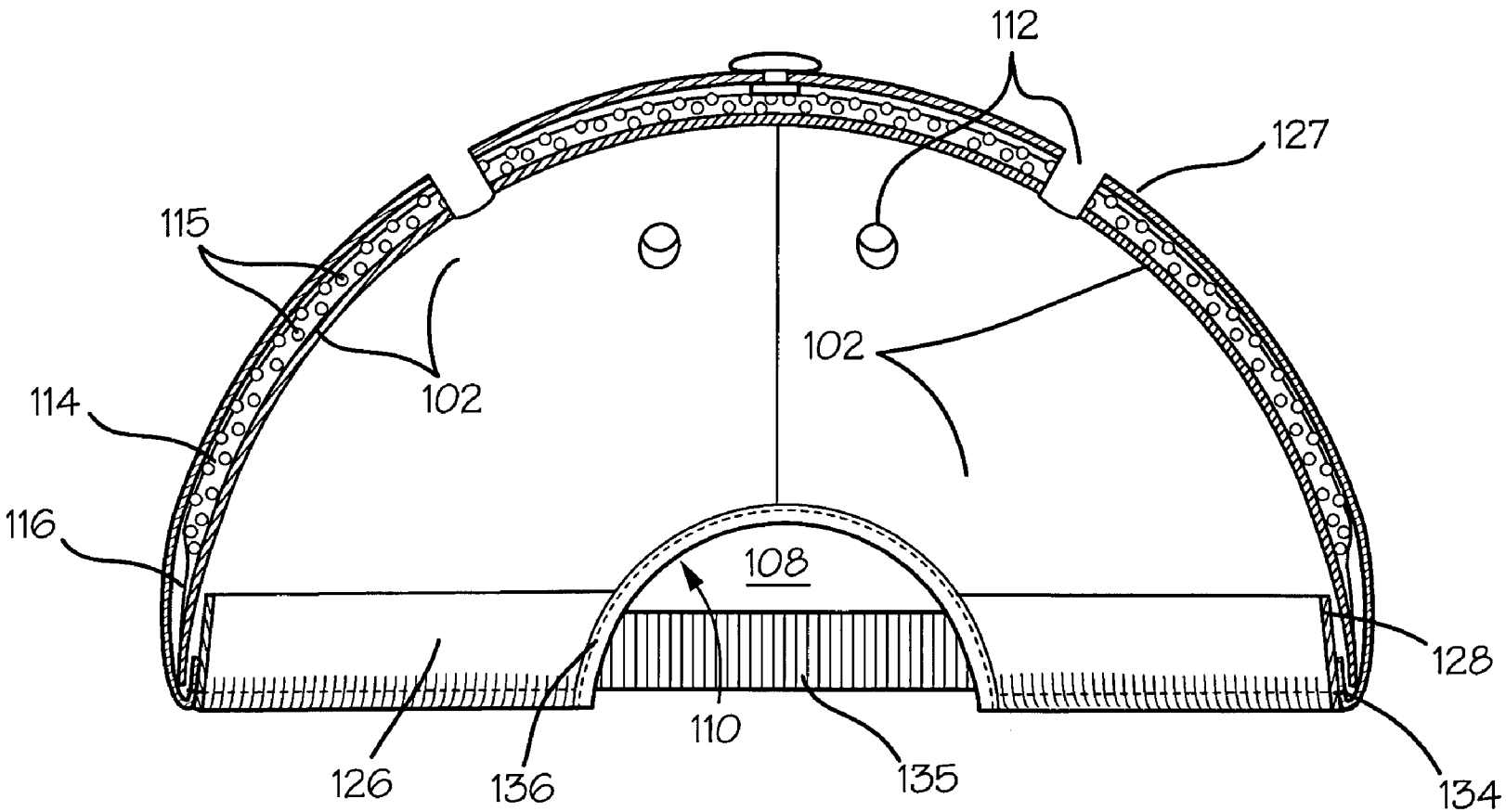

In addition to components shown in FIG. 1C, FIG. 1D shows ventilation holes 112 present in all layers at specified points. The weight pellets 115, which are components of the elastomeric weighted layer 114, are visible in this cross section. These are interspersed throughout the elastomeric weighted layer 114. Instead of the matching size adjustment buckle 131 and size adjustment strap 132 of FIG. 1C, here there is shown a single strap 135 which may be elastic. Alternatively, two mating strips of hook-and-loop fabric (not shown in FIG. 1D) may be used as a size-adjusting means. Finally, the edges 110 of semicircular opening 108 are shown with a finished treatment—a fabric covering 136 stitched to cover and bring together the edge of the crown 128 fabric, the side edge of the elastomeric weighted layer 114, and the side edge of the liner 102.

FIG. 1E depicts a weighted cap of the present invention 120, such as those described above, positioned on the head of a user 190. This positioning shows that the center of weight is near the spinal column (not shown). While not being bound to a particular theory, a position such as this is believed to provide superior benefit than other positions. FIG. 1E also shows, by dashed line, the shape of the user's head within the hat. This is termed herein as the line of fit 195. It is appreciated that the line of fit 195, in three dimensions, defines the ovoid hemispherical shape of a person's top, or crown section of his or her head.

Figure 2A:
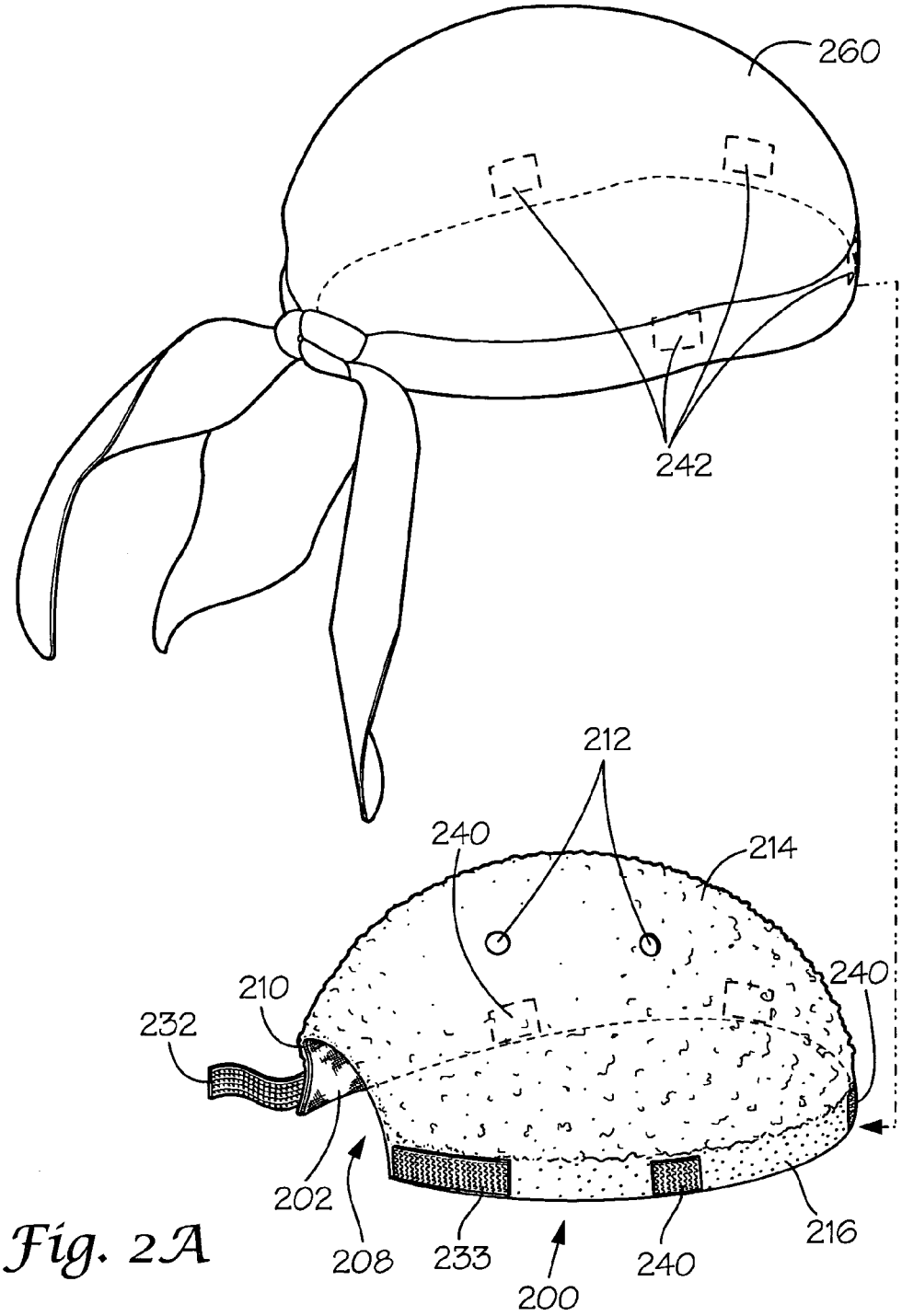
FIG. 2A provides a perspective view of a skullcap of the present invention, adapted for attachment to a bandana or other headwear as covering.
Figure 3A:
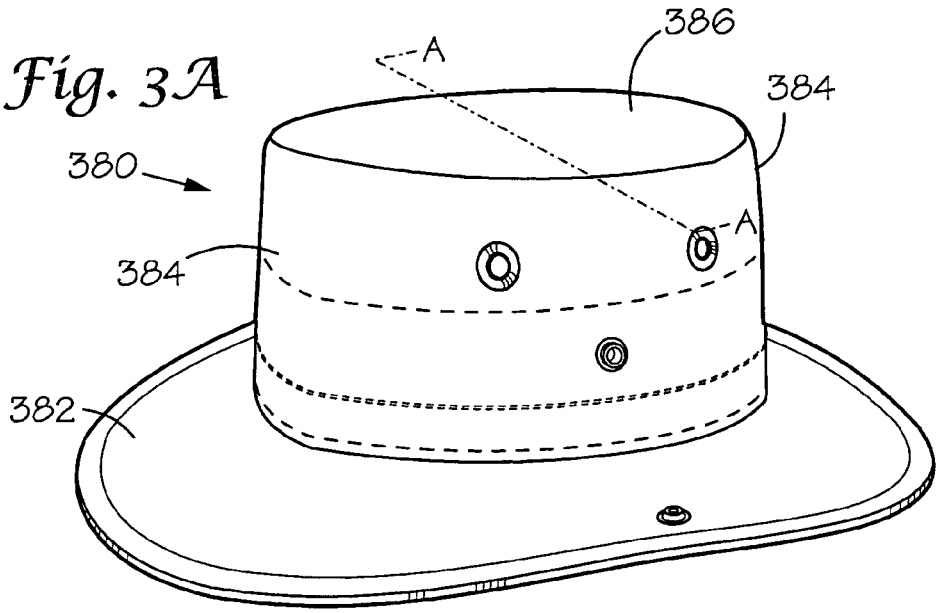
FIG. 3A provides a perspective view of a walking style hat.
Figure 3B:
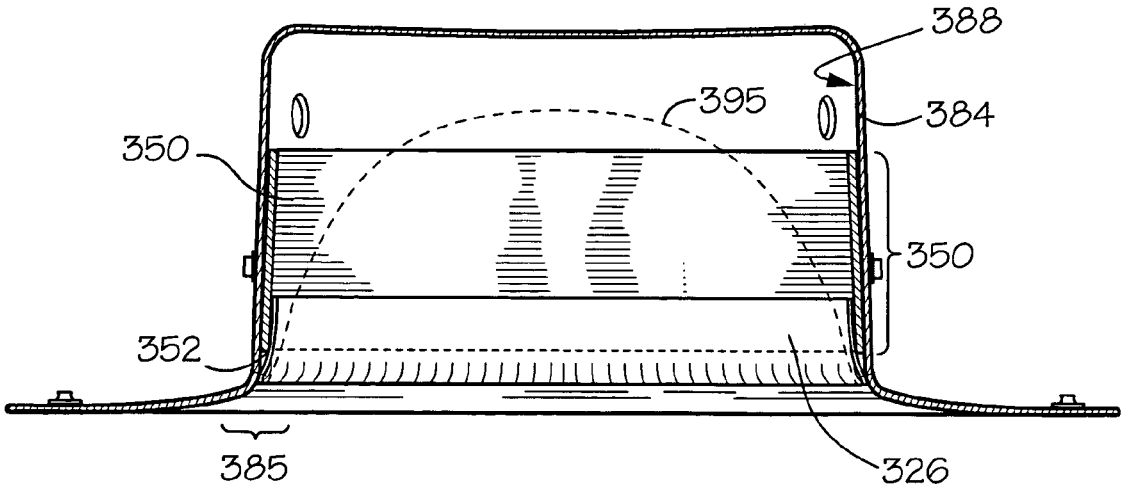
FIG. 3B provides a cross sectional view of the hat depicted in FIG. 3A, showing the presence and arrangement of a elastomeric weighted layer therein.

Embodiments of the present invention may be in the form of a weighted cap insert for insertion into a conventional hat (such as depicted in FIG. 1B), a stand-alone weighted structure (such as depicted infra, in FIG. 2A), or a conventional hat assembled with a formed weighted structure (such as depicted infra, in FIGS. 3A and 3B). The various features, as described for one embodiment, are understood to be utilizable in the other where appropriate. For example, FIG. 1F depicts an embodiment of a weighted cap insert 142 in which a pie-shaped slice of the elastomeric layer (not shown in detail in FIG. 1F) is removed to form a wedge-shaped sizing void 144. This provides for a more extensive ability to contract the size of the hat into which the cap insert 142 has been inserted or installed. Such pie-shaped voids may be used in any embodiment as appropriate. Also, multiple voids, of this or other shapes, or other means for sizing adjustment, as are known to those of ordinary skill in the art, may be employed instead of or in combination with the wedge-shaped void 144. Another approach of size adjustment, not to be limiting, is to make radial cuts down from the top of the structure. These cuts allow for expansion when fit onto a head larger than the shape of the cap insert, and when so expanded, form pie-shaped voids.

FIG. 2A shows another embodiment of the present invention in perspective view. FIG. 2A depicts a stand-alone skullcap, 200, comprised of elastomeric weighted material 214 over a fabric liner 202, here viewable through a semicircular opening 208 having edges 210. An adjustment strap 232 attaches to hook-and-loop fabric 233 on an opposing section of lower outside perimeter 216. As depicted the lower outside perimeter 216 is beveled smooth and thinned toward its bottom edge to better fit within any hat or other covering. The stand-alone skullcap 200 also comprises additional hook-and-loop fabric sections 240 advantageously positioned along lower outside perimeter 216 to secure any hat or other covering to the stand-alone skullcap 200. For example, and not to be limiting, a bandana 260, having mating hook-and-loop fabric sections 242 to mate with hook-and-loop fabric sections 240, is suited for placement over the stand-alone skullcap 200. This covers the stand-alone skullcap, 200, thereby allowing a user to gain benefit from the weight-loading by the stand-alone skullcap 200 without being the subject of looks and questioning by onlookers.

The stand-alone skullcap 200 depicted in FIG. 2A also is shown with two ventilation holes 212. As for other embodiments depicted herein, it is appreciated that the arrangement of ventilation holes 212, the design and placement of means for sizing adjustment, the placement of fastening means, such as the mating, opposing hook-and-loop sections 240 and 242, and other variable elements (such as, but not limited to, the use of hook-and-look fabric for reversible attachment), may be varied without departing from the scope of the present invention.

Figure 2B:
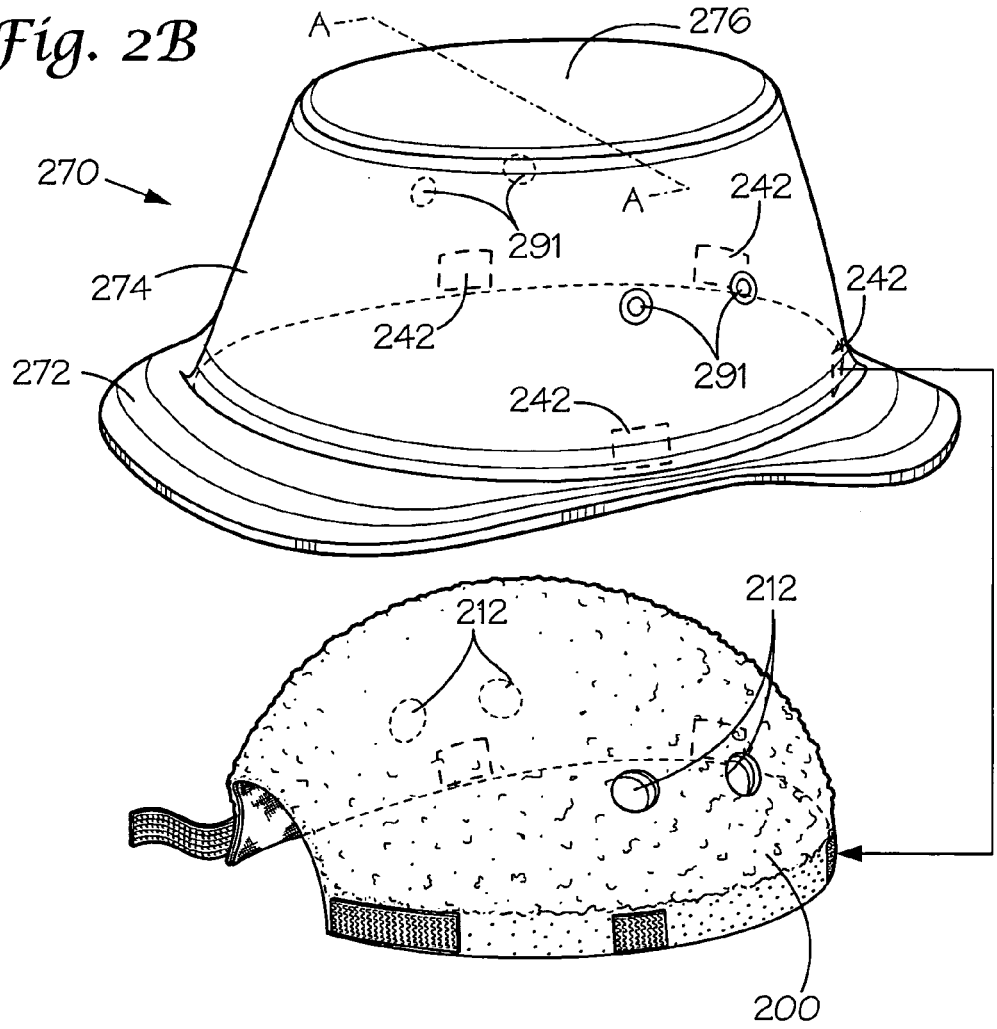
FIGS. 2B and 2C provide perspective and cross sectional views, respectively, of a walking style hat and a skullcap for insertion into it.
Figure 2C:
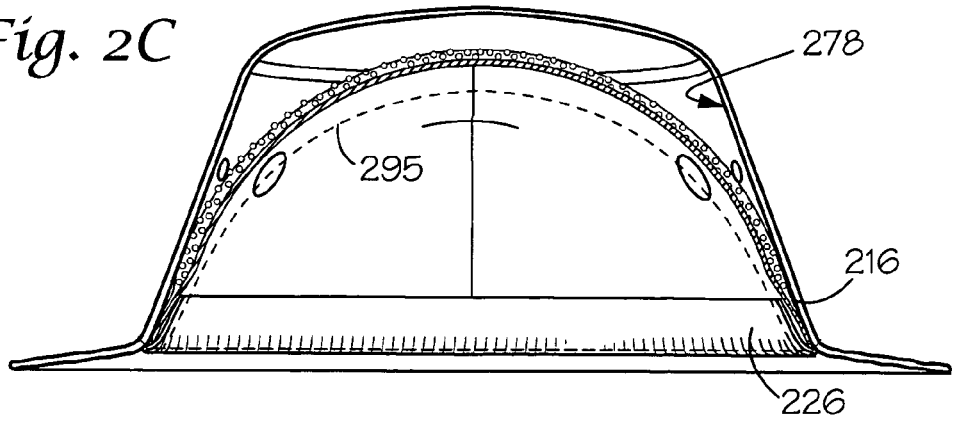

For example, FIG. 2B depicts a stand-alone skullcap 200 having ventilation holes 212 designed to generally conform to the ventilation holes 291 in hat 270. Hat 270 is comprised of a brim 272, a substantially vertical cylindrical wall 274, and a crown 276. Similarly to the arrangement in FIG. 2A, hat 270 comprises hook-and-loop sections 242 that oppose and mate with hook-and-loop sections 240 on skullcap 200 to provide for secure but reversible attachment. FIG. 2C provides a cross-sectional view of the skullcap 200 and hat 270 in FIG. 2B, where these are reversibly joined together, along line A—A in FIG. 2B. The beveled lower outside perimeter 216 is shown between the inner wall 278 of hat 270 and hat band 226 of hat 270, providing for cushioning and comfort during wearing. FIG. 2C also provides a dashed line depicting the line of fit 295, which shows where a head of a user typically fits within hat 270.

FIG. 3A provides a perspective view of another style hat, 380, identified as a walking hat. Hat 380 is comprised of a brim 382, a substantially vertical cylindrical wall 384, and a crown 386. In hat 380 a weighted elastomeric section is positioned along the substantially vertical cylindrical wall 384. This weighted elastomeric section 350 is viewable in FIG. 3B, which provides a sectional view taken along line A—A in FIG. 3A. Instead of a circular or ovoid hemispherical shape such as skullcap-shaped weighted elastomeric layers as depicted in FIGS. 1–2, the shape of weighted elastomeric section 350 is that of a truncated cylinder (or a truncated cone, depending on the angle of the wall 384). That is, a ribbon-shaped elastomeric weighted layer, longer than tall, is adapted to conform to the substantially cylindrical shape of the interior of said substantially vertical cylindrical walls. Whether the final shape of this ribbon-shaped elastomeric weighted layer defines a truncated cylinder or cone depends on the angle to which it conforms within the hat, such as against the substantially vertical wall (such as 384). FIG. 3B also provides a dashed line depicting the line of fit 395, which shows where a head of a user typically fits within hat 380.

As depicted in FIG. 3B, the bottom edge 352 of the cylinder-shaped ring of weighted elastomer section 350 fits between the inner side 388 of wall 384 of hat 380 and hat inner band 326. As appropriate based on the hat wall fabric or other material and the weigh load, the hat wall material is sized to provide needed rigidity to support the added weight. By sizing is meant the addition to the hat wall material of starch or other chemicals, as known in the art, to make the hat wall stiffer. Also, the base area 385 of hat 380, where the weight concentrates to the user's skull, may be appropriately cushioned by any means known to those of ordinary skill in the art.

It is noted that a weighted elastomeric section, such as disclosed herein with regard to FIGS. 3A and 3B, may be provided separately to insertion into any number of styles of conventional hats that comprise substantially vertical walls. Although not shown in FIGS. 3A and 3B, a columnar-shaped weighted elastomeric section may be made to have an adjustable circumference to more conveniently and broadly conform to a wider range of hat styles and sizes. For example, without being limiting, a 10 centimeter high band of weighted elastomeric material, having at both ends a hook-and-loop fabric section, may be made to form a cylindrical shape that fits to any number of hat sizes and shapes, with the hook-and-loop fabric sections mating to maintain the size and shape. Designs such as this, providing for adjustment, are advantageous for hats that do not have true cylindrical configuration, in that the adjustment means provides for adjustment to a desired deviation from true cylindrical shape (i.e., to form a truncated cone shape).

Figure 4A:
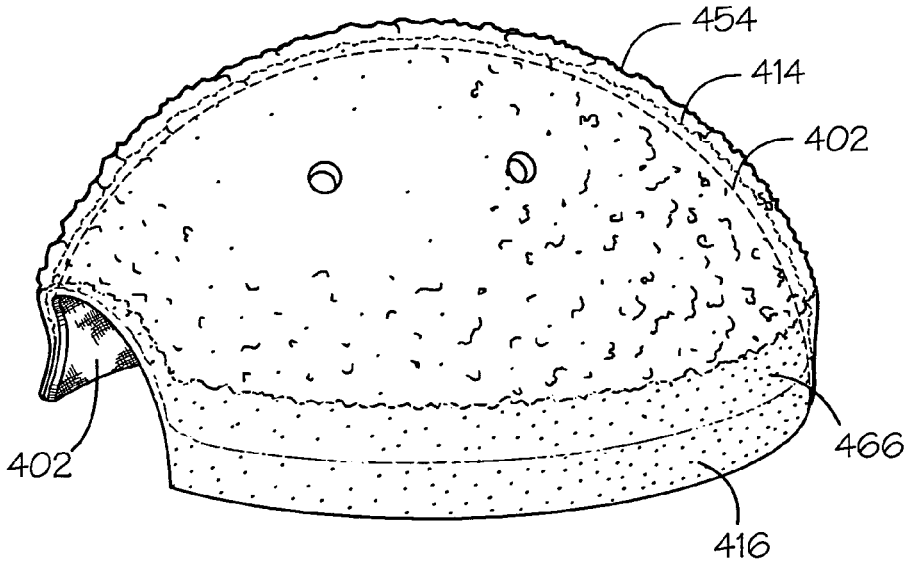
FIGS. 4A and 4B provide perspective and cross sectional views, respectively, of an embodiment in which an additional elastomeric weight layer is added to a weighted hat or weighted hat component of the present invention.
Figure 4B:
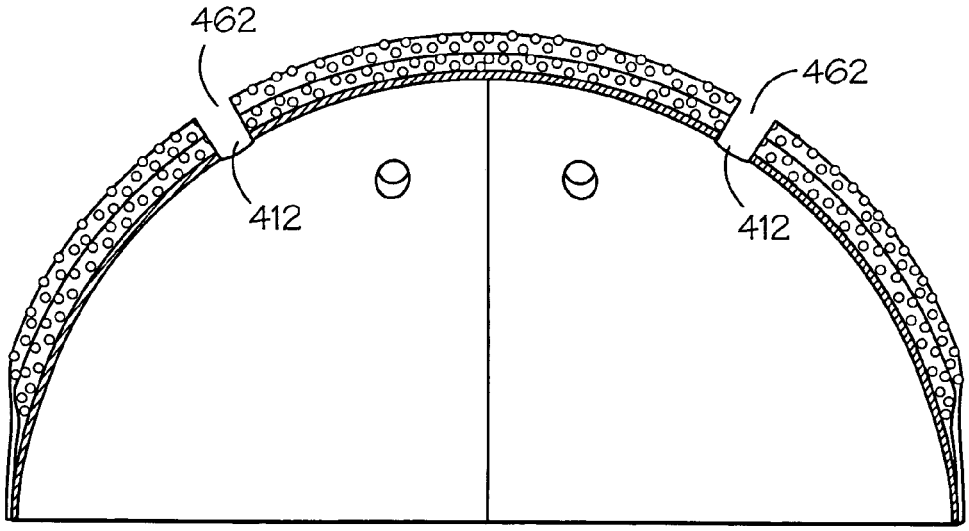

FIGS. 4A and 4B show one embodiment in which additional weight is added to a weighted hat or weighted hat component of the present invention. FIG. 4A depicts a perspective view of an elastomeric weighted layer 414 overlying a liner 402. A second elastomeric weighted layer, 454, is placed over the top of elastomeric weighted layer 414 to provide additional weight. This may be secured by any means of securing known to those of ordinary skill in the art, or may maintain its position by virtue of frictional and other association between the contacting surfaces. The so-formed assembly of the liner, 402, the elastomeric weighted layer 414, and the second elastomeric weighted layer 454 may be placed into a hat as a component thereof, or used as a stand-alone skullcap, as these alternatives are described herein. As depicted in FIGS. 4A and 4B, the second elastomeric weighted layer 454 has a tapered lower outside perimeter 466 that is confluent with the lower outside perimeter 416 of elastomeric weighted layer 414. Also observable in FIG. 4B is the confluence of ventilation holes 412 and 462.

Figure 5A:
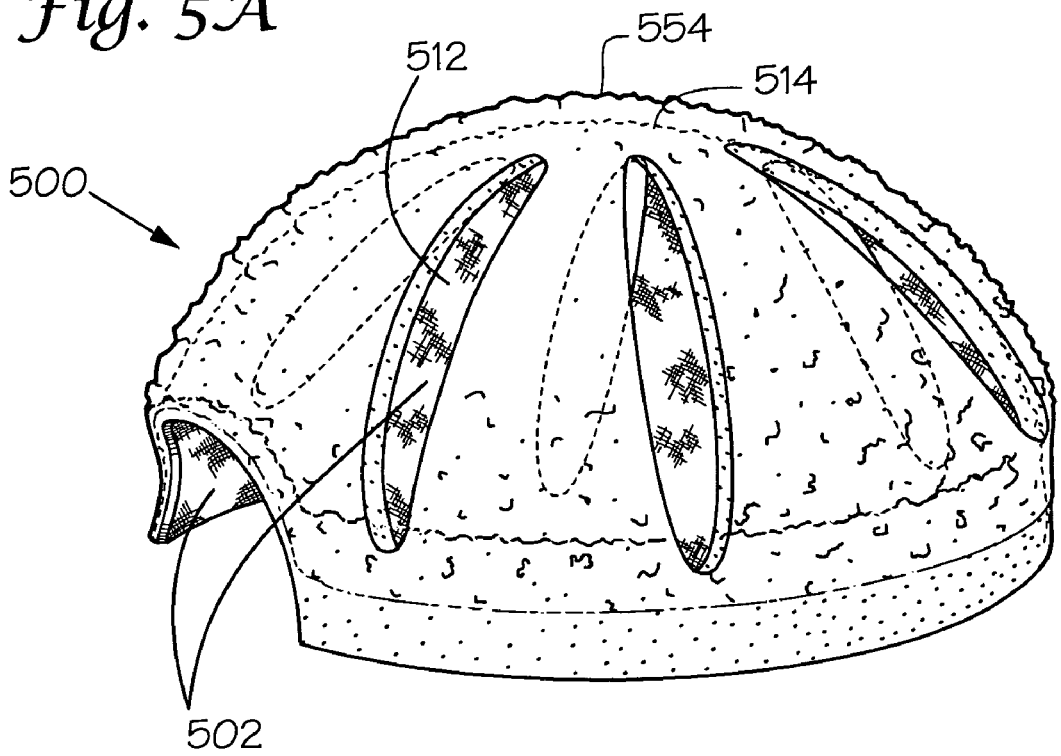
FIG. 5A provides a perspective view of one approach to providing increased ventilation in an elastomeric weighted layer.

Further with regard to ventilation, it is appreciated that wearing a weighted hat or other device of the present invention in warm, humid climates, while exercising, may result in substantial heat build-up. FIG. 5A depicts one design, not meant to be limiting, of the present invention for promoting ventilation while maintaining comfort and weight distribution. Shown in this perspective view of an elastomeric weighted layer subcombination 500 are six elongated oval voids, 512. These are evenly spaced and form vents through underlying liner 502, an elastomeric weighted layer 514, and a second elastomeric weighted layer 554.

Figure 5B:
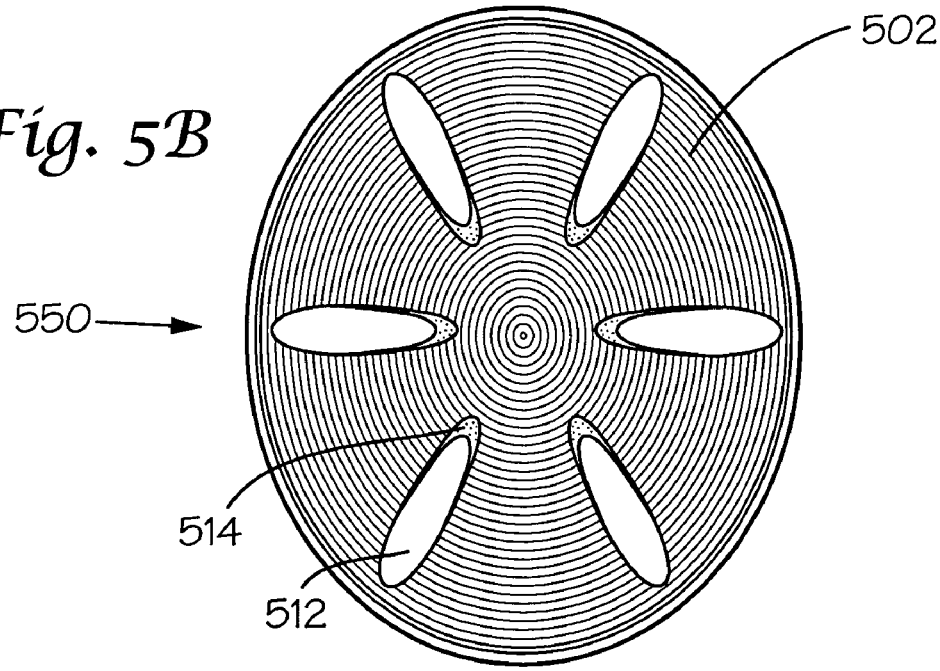
FIG. 5B provides an underside view of a similarly vented elastomeric weighted layer that has a different perimeter contour than the layer depicted in FIG. 5A.

FIG. 5B provides an underside view of an elastomeric weighted layer subcombination 550, also with six elongated oval voids, 512, which are evenly spaced and form vents through underlying liner 502, and a single elastomeric weighted layer 514 (viewable only along the beveled edge of voids 512). As for other subcombination structures disclosed herein, both this embodiment and the embodiment depicted in FIG. 5A may be incorporated into appropriate styles of hats and caps.

Figure 6A:
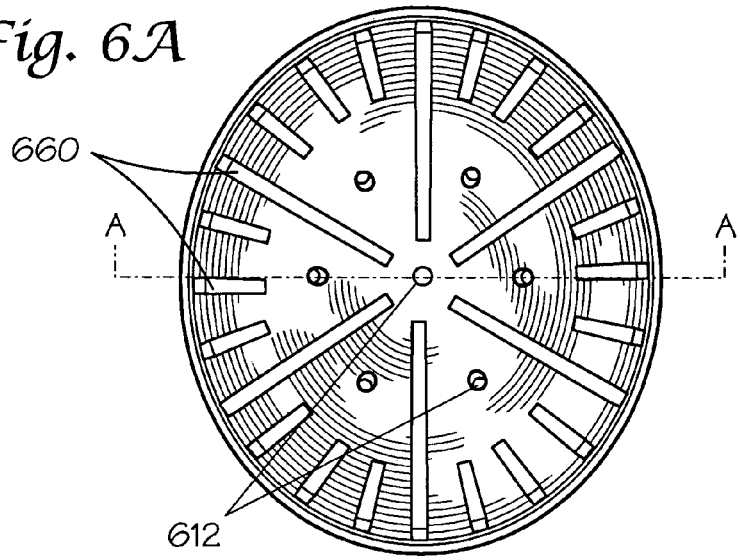
FIGS. 6A and 6B provide perspective and cross sectional views, respectively, of an embodiment in which spacing ridges are provided within an elastomeric weighted layer of the present invention.
Figure 6B:
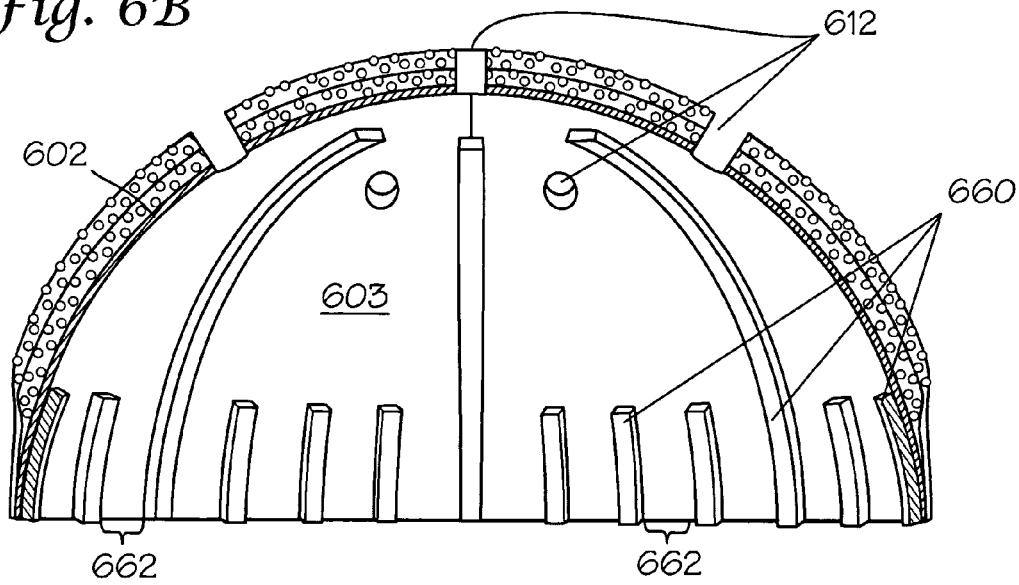

Another approach to providing for ventilation is depicted in FIG. 6A, showing the underside of a hat assembly comprising elastomeric weight layering, and FIG. 6B, which showing a cross-section view along axis A—A of FIG. 6A. In this embodiment, the ventilation holes 612 are more modestly sized than in FIGS. 5A and 5B, and a plurality of spacing ridges 660 are distributed on the inside surface 603 of liner 602. These spacing ridges are composed of any suitable material, and in certain embodiments are of a pliable material, such as plastic foam, to provide cushioning. They are oriented axially to permit the upward flow of warm air to the ventilation holes 612, and as shown provide gaps 662 that provide for outside air to travel up, into the space defined by the hat and the user's head, to replace rising warm air, thereby providing for air circulation and cooling.

Figure 7A:
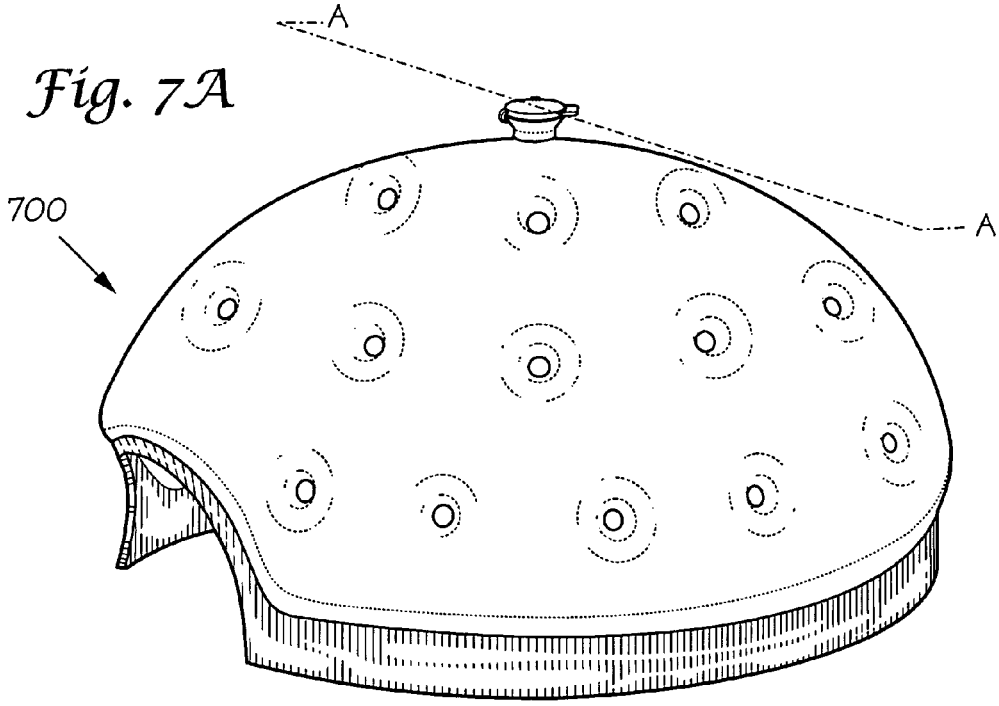
FIGS. 7A and 7B provide perspective and cross sectional views, respectively, of an embodiment of the present invention that provides a chamber for filling with a weighted material, for use in headwear of the present invention.
Figure 7B:
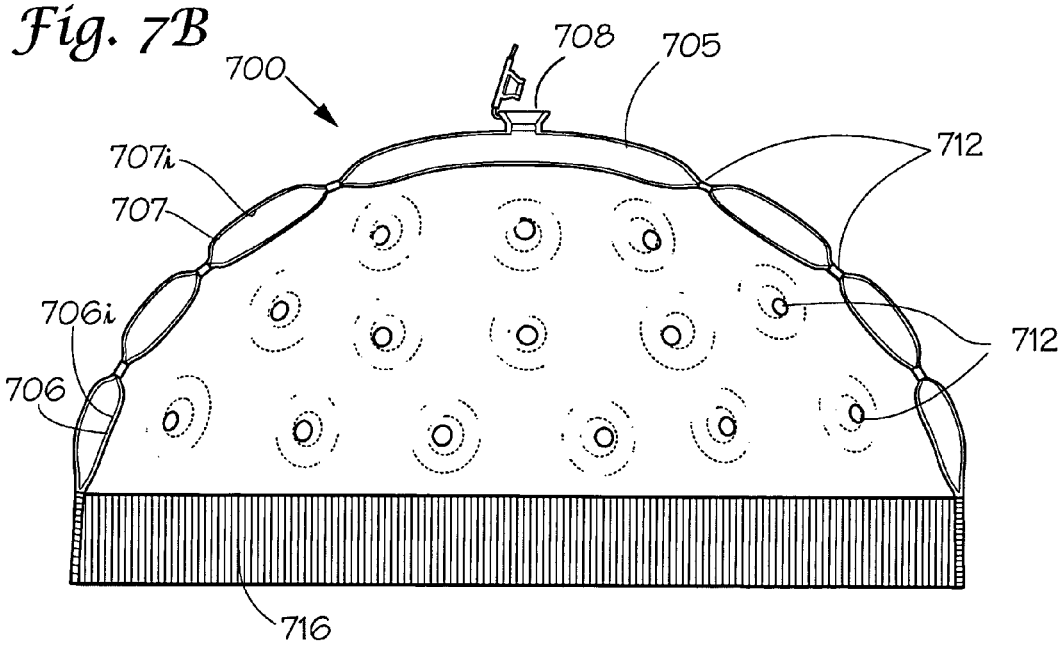

FIGS. 7A and 7B provide perspective and cross-sectional views, respectively, of another embodiment of the present invention comprising a rubber or plastic bladder having a shape to conform to the crown of a person's head. The rubber or plastic generally is resilient but possesses a desired flexibility to contour to the crown of a person wearing it. For example, without being limiting, one range for plastic flexibility is between about 60 and about 95 durometer units. In use, into this bladder, or chamber liquid or other flowable weight-increasing materials are added to attain a desired weight. Examples of suitable liquid and other flowable weight-increasing materials include, but are not limited to: water; oil; sand; other particulate flowable solid materials. This type of embodiment is referred to as a "weight-fillable bladder skullcap" because it is formed to fit over a portion of the crown of the head, and it is fillable with liquid and other flowable weight-increasing materials.

Generally, a weight-fillable bladder skullcap such as depicted in FIGS. 7A and 7B is constructed to form a chamber (i.e., a bladder) for filling with weighted material, and comprises a. an inner wall comprising an outer surface conforming to the shape of the crown of the head of a wearer of said skullcap, and an inner surface;

b. an outer wall, spaced a distance from said inner wall, comprising an outer surface and an inner surface;

c. a plurality of spaced apart junctures communicating between said inner wall and said outer wall;

d. a chamber between said inner surface of said inner wall and said inner surface of said outer wall, said chamber closed along a bottom border by a joining of lower edges of said inner wall and said outer wall; and e. a sealable opening accessing said chamber.

The FIG. 7B cross-sectional view is taken along the A—A axis of FIG. 7A. Here a weight-fillable bladder skullcap 700 is comprised of a chamber, 705, which is defined by the inner surface 706*i* of inner wall 706 and the inner surface 707*i* of outer wall 707. A sealable filler opening 708 provides for filling of the chamber with flowable liquid or flowable particulate material having desirable specific gravity. For instance, and not to be limiting, sand or water may be added to chamber 705.

As shown in FIG. 7B, penetrating the inner wall 706 and the outer wall 707 are a plurality of vents 712. These vents are forms of junctures that communicate between the inner wall 706 and the outer wall 707. In other embodiments, the junctures may be formed without providing ventilation vents 712. Also, a rigid band 716 forms a lower perimeter edge. This is but one embodiment of structure to have the chamber closed along a bottom border by a joining of lower edges of said inner wall 706 and said outer wall 707. In other embodiments, the lower edges of said inner wall 706 and said outer wall 707 are joined directly and there is no rigid band 716, for instance when a fillable bladder skullcap is designed for insertion into a particular style of headwear where a rigid band is not needed. In yet other embodiments, a non-bandlike structure can be placed between the lower edges of an inner wall and an outer wall. For instance, a flexible, rubber beading (circular in cross section) is used to separate the lower edge of an inner wall and the lower edge of an outer wall.

Embodiments of weight-fillable bladder skullcap such as depicted in FIGS. 7A and 7B may be incorporated into a specific hat, as described above for FIGS. 1D, 1E, 2B and 2C, or, alternatively, may be used as a stand-along skullcap-style weighted compartment, analogous to the embodiment depicted in FIG. 2A, and covered with various types of conventional caps and hats. In certain embodiments, when a weight-fillable bladder skullcap is filled with a liquid, after filling to a desired quantity, the chamber is squeezed to remove excess air, to minimize or eliminate head space in the chamber. Then the filler opening is closed. This reduces noise from sloshing liquid during exercise.

More specifically to one method of construction, one method to produce the elastomeric weighted layer shown in the above figures is to mix a room temperature curing liquid polyurethane rubber and size 'BB' steel shot. Then this is brushed or otherwise spread and smoothed onto a form, such as an underlayment such as a fabric liner of a desired shape. The mixture adheres to the fabric on application and is bonded to the liner at the completion of the rubber curing process. Using the brush-on method, a low profile elastomeric weighted layer, measuring approximately 5 mm in thickness, weighs about 770 grams. Using this layer, the completed headwear weighs about 850 grams. Adjustable length twill tape around the lower edge of various embodiments (or other means as described herein) allows for size adjustment. As indicated above, other ways for production include using a mold.

As observable in FIGS. 1–2 and 4–7, the weight-increasing layer is round to oval and convex in configuration in order to fit closely on the apex, or crown, of the head. Typically, the weight-increasing layer occupies the apical 75 to 95% of the cap. In certain embodiments, the thickness of such layer is less than 10 mm in thickness so as not to be too bulky.

The above-described method of brushing on a mixture of elastomer and weighted bodies is not meant to be limiting. Further as to construction choices and variations, an elastomeric weighted layer of the present invention itself may be constructed of several non-homogenous layers. For example, not to be limiting, an elastomeric weighted layer may be constructed of an inner layer comprised of elastomer without weighted bodies, a middle layer of discrete weighted bodies (applied with or without elastomer between the weighted bodies), and a top, covering layer of elastomer. Alternatively, an elastomeric weighted layer can be used in a hat without a liner.

Headwear of the present invention that utilize an elastomeric weight-adding layer as described herein provide greater comfort, and less shifting of the headwear and/or the layer, in comparison to other types of weight-adding layers as described herein. Advantages of the elastomeric types of weight-increasing layer is that they are generally flexible and lack hard edges. These features increase wearer comfort, and tend to increase a particular user's willingness to use the headwear of the present invention during his/her exercise activities.

The weight-increasing layer may be constructed in different weights to suit the individual wearer, to add mass from about 100 grams up to about 5,000 grams. More particularly, the weighted layer weighs between about 100 and about 3,000 grams, more particularly the weighted layer weighs between about 500 and about 2,000 grams. In certain embodiments, a standard range for headwear of the present invention, including the weight of the weighted component and the rest of the hat, cap, etc., is between about 100 and about 1,000 grams. Even more particularly for a standard user, the headwear weighs between about 200 and about 800 grams. Typically for standard users, the starting headwear weight is correlated to the particular user's body weight, and may consider factors such as age, sex and planned exercise (i.e., walking vs. more active forms). For standard users, the weight of the headwear generally is less than about two percent of the person's body weight, and can be less than one percent. Heavier headwear, between about 1,000 and about 5,000 grams, is for advanced users, i.e., those in better physical condition than the average user. More particularly, such headwear weighs between about 1,000 and about 3,500 grams, and even more particularly, such headwear weighs between about 1,000 and about 3,000 grams. While these latter ranges are provided for the total weight of the headwear, given the low weight of many hats and caps, these ranges also apply to only the weight of the weight-increasing layer, for example the elastomeric types of weight-increasing layer such as the weighted elastomeric layers and sections above.

For advanced users, the weight of the headwear generally is less than about three percent of the person's body weight, although it can be higher. This largely depends on the physical conditioning and the planned forms of exercise. That is, a higher weight (and percent of body weight) typically correlates with a less rigorous planned exercise, i.e., walking or jogging. It is noted that for headwear with such higher total weights, where it is desired to maintain a conventional look to the headwear, the weighted layer may be designed to fill voids in a fuller hat. For example, the area 295, between the outer wall of the weighted elastomeric layer 200 as shown in FIG. 2C and the inner wall 278 of hat 270 may be filled with additional elastomeric aggregate, as by having a thicker layer along the upper area of weighted elastomeric layer 200. Alternately, weighted bodies in the elastomeric aggregate are added to a higher percentage of the total mix, and/or denser weighted bodies are used. Also, as described herein, it is noted that the weighted layer need not be elastomeric.

In other embodiments of the apparatus of the present invention, additional weight is provided by incorporation of an internal (non-visible) layer of weight that conforms to the general shape of the head of the wearer. This layer of weight is comprised of metal, a composite including metal, minerals such as common sand, composites that include such minerals, dried beans and/or grains and the like, and shaped containers that contain a quantity of such materials. For instance, a shell conforming to the shape of the crown of a person's head is made of a metal alloy, and this is fitted into a baseball cap. Preferably, a suitable cushion is provided between such shell and the wearer's head. Another example of such embodiments is a fabric or plastic shell shaped to conform to the crown of a person's head, which is filled with sand or other weighted bodies to add weight, and which has sections stitched into it to retain the sand uniformly. In certain of such embodiments described in this paragraph, the apparatus of the present is fashioned, including the placement of the weights and the total weight of the particular embodiment, such that no chin strap, or other stabilizing strap, is needed when a person wearing such embodiment is engaged in the exercise for which that embodiment is designed (i.e., walking, jogging, aerobic exercise, etc.).

In other embodiments, a chin strap is incorporated into the design of the hat. This may attach to a cap or hat, or to a weighted layer directly. Further, although certain relationships for intimately associating, or combining or incorporating, a weighted layer with a conventional cap or hat are described herein, it is appreciated that numerous approaches to associate, combine or incorporate a weighted layer with a cap or hat may be employed. Bonding or attaching a weighted layer to a conventional cap or hat may include, but is not limited to, the following: folding between the headband and the hat wall; gluing; heat sealing; pressing; sonic welding; sewing; clipping with clips; snapping with snaps; spot gluing; and other means known to those skilled in the art.

In accordance with another aspect of the present invention there is disclosed an optional method of modifying the amount of weight in the weight-increasing layer. An alternative style of weight-increasing layer may be constructed to be 'layerable' thus allowing the wearer to add increments of additional weight to the initial, or starting weight of the hat. The increment weight layer can be added overlying the original weight layer using a Velcro-type attachment system. When an embodiment such as depicted in FIGS. 7A and 7B is used, the containment bladder comprises a sealable opening for the addition or removal of a desired amount of liquid or flowable material to attain a desired total weight. It is noted that starting with lower weight headwear for persons starting an exercise program is often desirable, and the above approaches allow for this.

In another approach, a portion of the additional weight is provided by one of the non-elastomeric or the elastomeric layers described herein, and an additional portion of additional weight is provided by weights that are attached separately to the headwear. That is, such supplemental weights are attachable by the user of the headwear when additional weight is desired. Such supplemental weights are selectively visible to an onlooker, or not visible to an onlooker, while attached to the headwear.

Despite the latter, it is noted that a key advantage of certain embodiments of the headwear of present invention is the ability of a wearer of such headwear without onlookers noticing that the headwear is not "normal" or "conventional" headwear. That is, when a user of the headwear of the present invention does not want others to know that the headwear is weighted, embodiments of the headwear are selected that look like any standard headwear. This results in embodiments of the weighted headwear of the present invention providing the added weight in an unobtrusive manner.

Other aspects of the present invention relate to methods of using the headwear of the present invention in different forms of exercise, to benefit wearers thereof. Such benefits include, but are not limited to, improved posture, increased development of bone mineral density during exercise with the headwear (generally for younger users), and decreased loss bone mineral density during exercise with the headwear (generally for older users).

For headwear of the present invention, it is appreciated that an underlayment, described above as a fabric layer, need not be present. For example, not to be limiting, a weight-increasing layer that is molded into a skullcap shape and used as is or as a component of a cap or hat, and has no underlying fabric liner. As another example, not to be limiting, the weight-increasing layer in FIGS. 2B and 2C need not have an underlayment. On the other hand, it is appreciated that the underlayment need not simply be a fabric layer. For example, not to be limiting, a cushioned foam layer may be the underlayment, directly in contact with the inside surface of the weight-increasing layer. Numerous variations in the design of a cushioned underlayment, providing for intermittent support and/or to providing for ventilation, may be developed based on knowledge and skill of those of ordinary skill in the art.

Further, whether as part of an attached or merely adjacent underlayment layer, or as part of the weight-increasing layer itself, the contour of the surface that contacts the head of a user may be varied in accordance with numerous preferences, priorities and theories. For example, not to be limiting, a cushioned foam layer may have hardened areas that create a desired pattern for weight transfer to the head. Alternatively, the weighted layer itself may have a desired pattern for weight transfer, whether or not a fabric, cushioned or other underlayment is also provided in such embodiments. In certain embodiments, such pattern advantageously provides a massage, by application of pressure from the weight of the headwear, to certain parts of the head while being worn. Alternatively, if a producer follows a theory about the benefit of magnetic fields, that producer may manufacture headwear of the present invention that has magnets disposed in desired locations in the weighted layer itself, or elsewhere.

Finally, it is recognized that the present invention is focused on the beneficial effects to the spine and related vertical load-bearing bones and joints. Appropriate exercise for other bones is recommended to enhance the condition of those bones.

The following examples describe studies that involve headwear of the present invention in exercise programs.

EXAMPLE 1

A pilot exercise study using headwear of the present invention was conducted with three adult volunteers, a 53 year-old male (subject A), a 55 year-old female (subject B), and a 53 year-old female (subject C). Baseline and post-study bone mineral density ("BMD") analyses were taken with the same machine using quantitative computed tomography ("QCT"). Each of the volunteers wore a weighted cap of the present invention and kept a log recording their respective minutes walked, distance traveled, and observations. All subjects continued with their existing habits of taking supplemental calcium (1–2 grams/day) and Vitamin D (400 IU/day).

The weighted layer of each hat used by each volunteer weighed about 700 grams, and each hat weighed about 800 grams in total. The goal of the study was to add an exercise walk 3–4 times per week for 40–60 minutes per walk. The study period spanned from the baseline to the post-study BMD determinations, which were 141 days (~0.4 years, or 3 months) apart. A summary of the data is provided in the following table:

| | Record of Walks | | | Baseline QCT data | | | Post-Study QCT data | | | | % |
|---|---|---|---|---|---|---|---|---|---|---|---|
| Subject | Walks | Hours | Miles | BMD, average | T-score | Z-score | BMD, average | T-score | Z-score | Change in BMD | BMD change |
| A* | 57 | 35 | 133 | 91.0 | −2.2 | −0.5 | 105.6 | −1.6 | 0.0 | 14.6 | 16 |
| B | 77 | 60 | 178 | 128.0 | −0.3 | 1.6 | 126.2 | −0.4 | 1.5 | −1.8 | −1 |
| C | 67 | 48 | 142 | 132.5 | −0.1 | 1.5 | 135.9 | 0.0 | 1.7 | 3.4 | 3 |

*See discussion, infra.

Subject A's baseline BMD indicated he was osteopenic despite his normal high level of physical activity. In addition to the walks record shown above, Subject A also rode a bicycle about 900 miles during the first three months of the study. At day 111 of the study, while training for a specific bicycle trek, he fell and sustained an intertrocanteric hip fracture. Surgery was required, involving open reduction and metal screw and plate fixation. Subject A reported tolerating wearing the hat and a noticeable improvement in posture.

Subject B did not report unusual incidents during the study period, and did report tolerating the hat and a very noticeable improvement in posture. However, the difference between the baseline and the post-study BMD measurements were negligible (and actually showed a small decrease in BMD).

Subject C did not report unusual incidents during the study period, and did report tolerating the hat and a noticeable improvement in posture. At the time of the study, Subject C was peri-menopausal and had been taking hormone replacement therapy for four years. In addition to the walks, Subject C is generally active and played tennis about twice weekly. The BMD results indicate a 3 percent gain in BMD, which is considered greater than expected test variation.

While demonstrating variability, these results indicated the potential for general improvement of BMD (and, concurrently, bone strength) with use of weighted headwear of the present invention. It is noted that results of one published longer term study regarding exercise and BMD changes shows that an average BMD increase below three percent was found significant.

EXAMPLE 2

A walking exercise trial with control groups evaluates the effects of adding a weighted hat according to the present invention to activities of postmenopausal women. Initial bone mineral density determinations are made prior to initiation of the trial. Control and treatment groups include: non-regimented exercise control (allowed to do standard activities, but not participating in the regimented and monitored exercise); regimented exercise control (walking for 30–60 minutes three times per week ("regimented walking"), with no weighted hat); regimented walking with 100 g weight hat; regimented walking with 200 g weight hat; regimented walking with 300 g weight hat; regimented walking with 400 g weight hat; regimented walking with 500 g weight hat; and regimented walking with 1,000 g weight hat. Lighter weight individuals are provided with lighter weight hats disproportionately to encourage compliance and completion of the trial.

After a six-month period of study, observations are made, including changes in bone mineral density, and data are compared for treatments with the weighted hats, the non-regimented control, and the regimented exercise control. The benefits are evaluated to refine the assessment of the appropriate weights (and percent body weight) for various groups of users. This trial is expected to support the benefits of using a weighted hat of the present invention during standard exercise, in particular walking.

EXAMPLE 3

The effect of use of wearing a weighted hat according to the present invention during an aerobic exercise regime is determined. Volunteers are solicited, evaluated, and selected who participate in a standard aerobics class of medium intensity. Initial bone mineral density determinations are made prior to initiation of the trial. Control and treatment groups include: aerobic exercise control (participate in aerobics class 2–4 times per week, with no weighted hat); same aerobics class wearing a 100 g weight hat; same aerobics class wearing a 200 g weight hat; same aerobics class wearing a 300 g weight hat; and same aerobics class wearing a 400 g weight hat. Lighter weight individuals are provided with lighter weight hats disproportionately to encourage compliance and completion of the trial. Results take into account the attendance frequency by each participant. All participants are encouraged to exercise in the class at least twice per week. Participants agree that this exercise is their primary exercise for the study period and other exercise is recorded and reported to the study manager.

At three and six months, data, including changes in BMD, are obtained for treatments with the weighted hats and compared to data of the aerobic exercise control. The data are evaluated to refine the assessment of the appropriate weights (and percent body weight) for various groups of users. This trial is expected to support the benefits of using a weighted hat of the present invention during standard exercise, in particular aerobic class exercise.

EXAMPLE 4

It is known that individual responses to an exercise regime designed to improve BMD and/or strength is variable, and some persons have little or no positive result, while others improve dramatically. Without being bound to a particular theory, it is possible that for some individuals, the force needed to properly stimulate osteoblasts to induce bone reformation must be greater than for others.

To test this possibility, volunteers from the lower two quartiles in the study described in Example 3 are in a follow-up study. The experimental treatments in the follow-up study include the variables: additional weight in each person's hat; and an alteration of the exercise regime to include a greater segment of higher impact aerobic exercises.

As for the previous study, pre-study initial bone mineral density determinations are made prior to initiation of the trial. The specific control and treatment groups include: aerobic exercise control (participate in aerobics class 2–4 times per week, with no weighted hat); same aerobics class wearing a 300 g weight hat (for individuals from both quartiles); same aerobics class wearing a 500 g weight hat (for individuals from both quartiles); same aerobics class wearing a 700 g weight hat; and same aerobics class wearing a 900 g weight hat.

Results take into account the attendance frequency by each participant. All participants are encouraged to exercise in the class at least twice per week. Participants agree that this exercise is their primary exercise for the study period and other exercise is recorded and reported to the study manager.

At three and six months, data, including changes in BMD, are obtained for treatments with the weighted hats and compared to data of the aerobic exercise control. The data are evaluated to refine the assessment of the appropriate weights (and percent body weight) for various groups of users. This trial is expected to support the benefits of using a weighted hat of the present invention during standard exercise, in particular aerobic class exercise. This study also is to demonstrate whether certain persons unable to obtain substantial benefits at lower weights may be of such physiology and physical constitution that higher weights and/or increased amounts of specific higher impact exercises will allow such individuals to achieve appreciable BMD and/or strength improvement using the weighted hats of the present invention.

More generally, it is appreciated that headwear of the present invention may be used while engaged in numerous forms of exercise in addition to walking, jogging and running, whether outdoors or on a treadmill. For example, and not to be limiting, headwear of the present invention may be worn during dancing, rope jumping, jumping on a trampoline, stair walking or running, and a range of team sports, including but not limited to soccer and volleyball. As appropriate, break-in periods using relatively lower total weight of head wear, provide for muscle strengthening. While such headwear is routinely worn during team practice sessions, it is appreciated that such headwear is not worn during competitive matches, where the additional weight and correspondingly lower performance (whether measured by speed, endurance, or other parameters) is undesirable.

Based on the above, methods of using weighted headwear of the present invention apply to various forms of exercises and games (i.e., sports), and generally include the steps of a. positioning on a person's head a conventionally-shaped headwear comprising an added mass, wherein such added mass is confined within a space within said hat; and
b. exercising for a period of time with said hat positioned on said person's head.

The positioning may involve separately placing a weighted skullcap, or the like, atop one's head, and then placing a conventional hat over this to render it unobtrusive. Alternatively, a weighted headwear that contains a weighted mass within it, such as an elastomeric weighted layer, may be used. Also, repeating steps a and b together at sufficient frequency and duration, provides a desired beneficial effect. For instance, exercising, such as walking, at least 3 days in a 7-day period is considered sufficient; continuing this exercise for weeks or months provides a desirable augmentation above what is obtainable with the same exercising but without wearing such weighted headwear. However, other forms of exercise, and games (i.e., sports), as disclosed herein and additionally as known in the art of exercise, may be the choice of exercise or game used by a person who is employing this method.

Further as to sufficient duration, for persons desiring to decrease the effects of aging on bone mineral density losses, periodic exercising, such as walking, is targeted to continue for a sufficient period to stabilize or increase the bone mineral density for such persons. This will depend on various factors, as described above, and is quantifiable by means of testing for bone mineral density.

While a number of embodiments of the present invention have been shown and described herein, it is apparent that such embodiments are provided by way of example only. For instance, while details of cap construction were provided in the discussion corresponding to FIGS. 1A–F, it is appreciated that other designs and construction methods exist, and may be employed for cap and hat construction for headwear of the present invention. More generally, numerous variations, change and substitutions will occur to those of ordinary skill in the art without departing from the spirit and the scope of the present invention. Also, presently unforeseeable modifications may be implemented yet still provide embodiments within the spirit and scope of the present invention. With this in view, it is intended that the invention be limited only by the spirit and scope of the appended claims.

What is claimed is:

1. A weighted hat or cap comprising:

a. a skullcap, shaped to conform to the crown of the head of a human subject, comprising an elastomeric weighted layer comprised of an elastomer and a quantity of weighted bodies, and weighing between about 100 and about 3,000 grams; and
b. a conventional-style hat or cap having an adaptation to receive as an inner component said skullcap.

2. The weighted hat or cap of claim 1, wherein said weighted bodies are selected from the group consisting of iron shot, steel shot, and lead shot.

3. The weighted hat or cap of claim 1, wherein said elastomeric weighted layer weighs between about 500 and about 2,000 grams.

4. The weighted hat or cap of claim 3, wherein said elastomeric weighted layer has a thickness between about 5 and about 10 millimeters.

5. The weighted hat or cap of claim 1, wherein said elastomeric weighted layer is comprised of a polymeric elastomer, and interspersed therein a quantity of weighted bodies.

6. The weighted hat or cap at claim 5, additionally comprising a fabric liner adhered to the inside surface of said elastomeric weighted layer.

7. The weighted flat or cap of claim 1, wherein the adaptation comprises a plurality of spaced sections of hook and loop fabric on the inside of said weighted hat or cap, positioned to reversibly adhere to opposingly positioned spaced sections of hook and loop fabric on the outside of said skullcap.

8. The weighted hat or cap of claim 1, wherein said weighted hat or cap is selected from the group consisting of boater, bowler, bucket, cowboy hat, derby, fedora, floppy hat, hamburg, pillbox, Stetson-styled hat, trilby, baseball cap, beret, cloche, fez, newsboy cap, skullcap, and turban.

* * * * *